US009061739B1

(12) United States Patent
Thomson et al.

(10) Patent No.: US 9,061,739 B1
(45) Date of Patent: Jun. 23, 2015

(54) SELF-STABILIZING BUOY AND DEPLOYMENT METHODS

(71) Applicants: Bret R. Thomson, San Diego, CA (US); Steve Whiteside, Jamul, CA (US); Brandon J. Wiedemeier, San Diego, CA (US); Steven J. Horstman, El Cajon, CA (US); Michael Tall, San Diego, CA (US); Ronald Allen Skala, Murrieta, CA (US)

(72) Inventors: Bret R. Thomson, San Diego, CA (US); Steve Whiteside, Jamul, CA (US); Brandon J. Wiedemeier, San Diego, CA (US); Steven J. Horstman, El Cajon, CA (US); Michael Tall, San Diego, CA (US); Ronald Allen Skala, Murrieta, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 7 days.

(21) Appl. No.: 14/153,118

(22) Filed: Jan. 31, 2014

(51) Int. Cl.
*B63B 22/20* (2006.01)

(52) U.S. Cl.
CPC ..... *B63B 22/20* (2013.01)

(58) Field of Classification Search
CPC ..... B63B 22/24; B63B 22/26; B63B 22/003; B63B 22/20
USPC ..... 441/21, 28, 29; 367/4; 114/317, 121, 114/124
See application file for complete search history.

(56) References Cited

U.S. PATENT DOCUMENTS 6,052,332 A * 4/2000 Obara ..... 367/1
8,512,088 B2 * 8/2013 Jone et al. ..... 441/21

* cited by examiner

*Primary Examiner* — S. Joseph Morano
*Assistant Examiner* — Andrew Polay
(74) *Attorney, Agent, or Firm* — SSC Pacific Patent Office; Arthur K. Samora; Kyle Eppele

(57) ABSTRACT

A self-stabilizing buoy and deployment methods can include a main body and a cage that can be attached to the main body. A ballast can be slidably positioned within the cage so that the ballast moves from within said cage to outside of the cage when the buoy is deployed. The cage can be formed with at least one slot. The buoy can include a locking mechanism to fix the ballast at the distal end of cage after deployment, which can include a locking head that can be fixed to the ballast and inserted into the slot, and at least one flexible cantilevered arm that can extend from the cage into the slot at its distal end. As the buoy is deployed, the weight of the ballast can be sufficient to urge the locking head past the cantilevered arm to fix and lock the ballast during buoy deployment.

16 Claims, 4 Drawing Sheets

SELF-STABILIZING BUOY AND DEPLOYMENT METHODS

FEDERALLY-SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil, referencing NC 102679.

FIELD OF THE INVENTION

The present invention pertains generally to buoys. More specifically, the present invention pertains to self-stabilizing buoys with structure that can facilitate stowage and transport, but can also change to increase the buoy stability as the buoys are deployed.

BACKGROUND OF THE INVENTION

Buoys are well known in the prior art for use in various purposes, including marking navigational hazards, aids to navigation channels, etc. In some instances, buoys are deployed from a ship. In other instances, it may be desired to deploy a buoy from a stowage configuration that is already underwater. Reasons for such stowage can include preventing (or at least slowing) the growth of marine growths such as kelp on the outer hull of the buoy.

Before the buoy can be deployed the buoy often must be transported to the deployment location. Transportation space costs resources for the deployment vehicle, whether it is a ship, UUV, or aerial vehicle; thus, any advantage that allows for compact buoy storage prior to deployment can be desired.

Once the buoy is at the desired deployment location, however, the needs of the user can change. Buoys are often designed so that the separation distance between the center of gravity (CG) and the center of buoy (CB) is a great as possible. The greater the separation distance, the more stable the buoy is in the water. But a large separation distance can also run counter to the compactness proposition. Thus, what is desired is a buoy that can be compact during transportation, but can also have a separation distance that promotes stability (i.e., not be compact) after deployment.

Additionally, if may often be necessary to deploy large number of buoys. For these instances, it can be extremely disadvantageous to the operator to have to take the time to modify the structure of each buoy to "set" the buoy prior to deployment. Further, the use of electronic or other active actuated methods can add to costs, complexity, and can add leak points via siding seals in the case of a pressure vessel. Any lip or edge that is exposed becomes a snag point for kelp and if the system is not rigid enough, it lends itself to possible jamming or partial retraction due to wave action.

In view of the above, it is an object of the present invention is to provide a self-stabilizing buoy that has a compact configuration for storage and transportation. Another object of the present invention is to provide a self-stabilizing buoy which has a relatively large separation distance between the (CB) and (CG) for good stability after deployment. Still another object of the present invention to provide a self-stabilizing buoy that can increase the separation distance between the (CB) and (CG) during deployment of the buoy without intervention of the operator. Yet another object of the present invention to provide a self-stabilizing buoy, which can transition from a transportation configuration to a deployed configuration automatically, without any activation or arming by the user. Another object of the present invention to provide a self-stabilizing buoy that can transition from a stowage configuration to a deployed configuration without any power, and without having an adverse effect on the buoy ability to shed kelp. Another object of the present invention is to provide a self-stabilizing buoy and methods of deployment that are easy to use in a cost-efficient manner.

SUMMARY OF THE INVENTION

A self-stabilizing buoy and methods for deployment therefor in accordance with several embodiments of the present invention can include a main body and a cage that can be attached to the main body. The cage can have a proximal end and a distal end, and the proximal end of the cage can be attached to that body. A ballast can be slidably positioned with the cage so that the ballast moves from within said cage at the cage proximal end when the buoy is in stowed configuration to outside of the cage at the cage distal end when the buoy is in a deployed configuration.

The buoy can include a locking mechanism to fix the ballast at the distal end of cage when the buoy is deployed. To do this, the cage can be formed with at least one slot, and a locking head can be fixed to the ballast and the inserted into the slot. At least one flexible cantilevered arm can extend into the slot at its distal end. With this configuration, as the buoy is deployed, the weight of the ballast can be sufficient to orient the buoy vertically and urge the locking head past the cantilevered arm to fix the ballast when the buoy is deployed. In several alternative embodiments, the cage can be formed with a strut in lieu of the cantilevered arm. The strut can extend into the slot, and the weight of the ballast can be sufficient to urge said locking head past the strut.

For all of the embodiments above, the buoy can have a stowed configuration, a deployed configuration, a center of gravity (CG), a center of buoyancy (CG) and a separation distance between the CG and the CB. Once the buoy becomes deployed, the separation distance between CG and CB can be greater for the deployed configuration than for the stowed configuration, to thereby establish a buoy with a compact stowage configuration, but also with a greatly increased stability once deployed.

BRIEF DESCRIPTION OF THE DRAWINGS

The novel features of the present invention will be best understood from the accompanying drawings, taken in conjunction with the accompanying description, in which similarly-referenced characters refer to similarly-referenced parts, and in which.

DETAILED DESCRIPTION OF THE EMBODIMENTS

Figure 1:
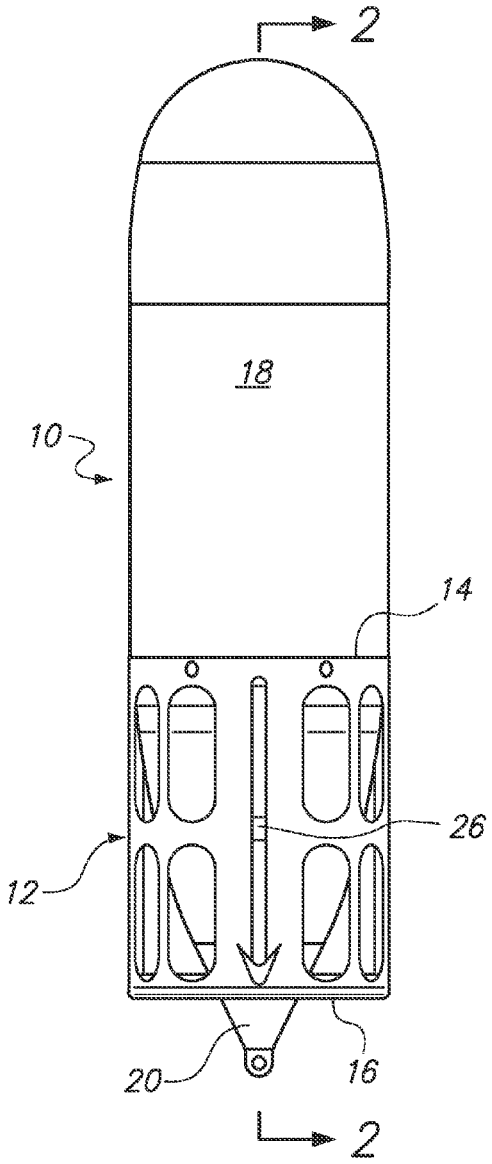
FIG. 1 is a side elevational view of a self-stabilizing buoy of the present invention according to several embodiments.
Figure 2:
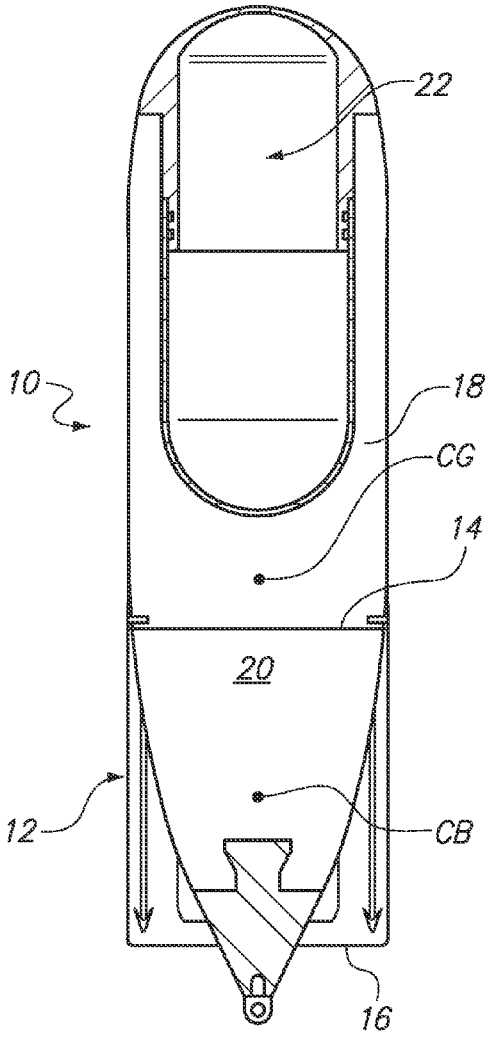
FIG. 2 is a cross-sectional view taken along line 2-2 in FIG. 1.
Figure 3:
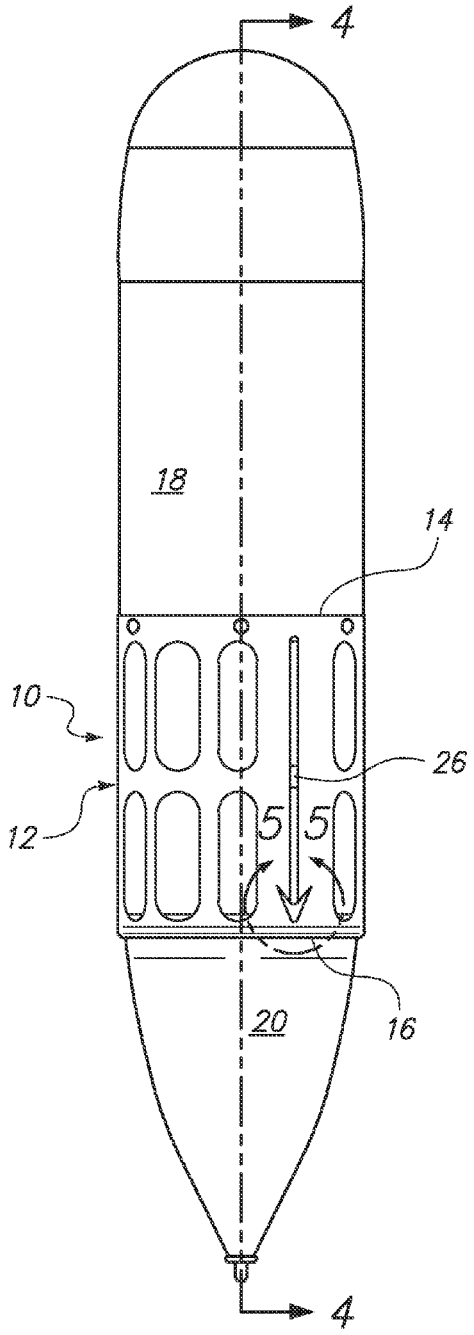
FIG. 3 is a side elevational view of the buoy of FIG. 1 when the buoy is in a deployed configuration.

Referring initially to FIGS. 1-4, a self-stabilizing buoy according to several embodiments of the present invention is shown and is generally designated by reference character 10. As shown in FIGS. 1-4, buoy 10 can include a cage 12 with at proximal end 14 and a distal end 16. Cage 12 can be fixed to a main body 18 at proximal end 14. Buoy 10 can also include ballast 20. As shown in FIGS. 1-2, buoy 10 can have a stowed configuration (also referred to as a transportation configuration, the terms "stowed" and "transportation" are used interchangeably), wherein ballast 20 is substantially located within cage 12. As shown in in FIGS. 3-4, buoy 12 can also have a deployed configuration, wherein ballast 20 extends past distal end 16 of cage 12. A payload 22 can be located within main body 18 to accomplish the intended functionality of the buoy 10 once it is deployed. The structure and manner in which buoy transitions from a transportation or stowed configuration to a deployed configuration is discussed more fully below.

Cage 12 can further be formed with at least one slot 24, as shown in FIG. 1-6 (in the Figures, three slots 24 are shown in cage 12 but the buoy 10 could have any number of slots 24). In order to allow the buoy 10 to transition from a transportation configuration to a deployed configuration, a locking head 26 can be fixed to ballast 20 and positioned within slot 24. The locking head(s) 26 can facilitate the sliding process and prevent the ballast 20 from going askew within cage 12 as it slides downward, from the proximal end 14 towards distal end 16 of cage 12.

Figure 5:
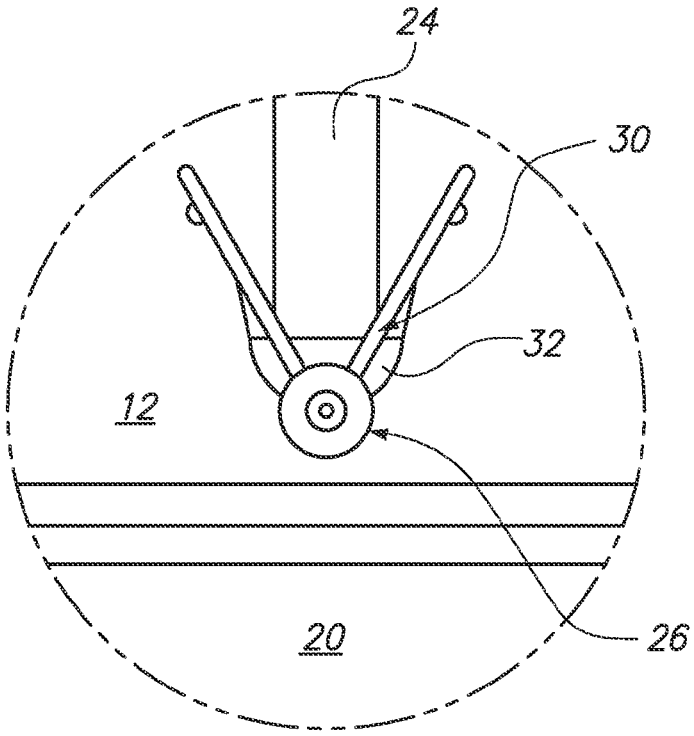
FIG. 5 is a greatly enlarged side elevational view of the locking mechanism portion of the buoy of FIG. 3 taken along line 5-5 in FIG. 3.
Figure 6:
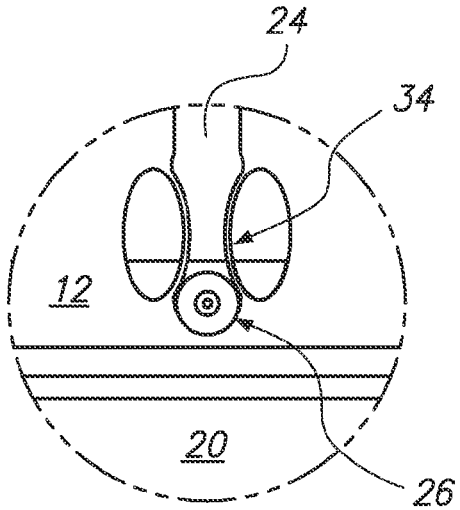
FIG. 6 is an alternative embodiment of the locking mechanism of FIG. 5; and, FIG. 7 is a block diagram, which illustrates steps that can be taken to accomplish the methods of the present invention according to several embodiments.

As perhaps best seen in FIGS. 5 and 6, the buoy 10 can include a locking mechanism 28 to fix the ballast 20 in place after deployment of the buoy 10. As shown in FIG. 5, one locking mechanism 28 according to several embodiments can include at least one flexible cantilevered locking arm 30, which can extend from cage 12 at least partially into slot 24. As also shown in FIG. 5, slot 24 can merge into a widened niche 32 at the distal portion of cage 12. Thus, locking mechanism 28 can be thought of as the cooperation of structure between the locking head 26 on the ballast 20, the slot 24 and the cantilevered arm(s) 30 to fix ballast 20 in place once it is deployed.

When the buoy is deployed (dropped into the water or released from an underwater docking station, not shown), the weight of the ballast 20 can be sufficient to orient the buoy 10 vertically and cause the ballast 20 to move downward. As the ballast 20 continues to slide downward the locking head 26 can come into contact with a corresponding cantilevered locking arm 30. Because the locking arm 30 is flexible, the material of the locking arm can be chosen to have flexibility such that the weight of ballast 20 is sufficient to urge the locking head 26 past locking arms 30 and seat in niche 32, to thereby lock the ballast in place. This configuration can be illustrated in FIG. 5. If it is desired to retrieve the ballast, niche 32 can have structure (it is slightly flared) that can allow the cantilevered arms to yield enough to manually push the ballast back past cantilevered arms 30 towards proximal end 14 and into the cage 12, to re-establish the stowage/transportation configuration for buoy 10.

Referring now to FIG. 6, an alternative embodiment of the present invention can be seen. In FIG. 6, the cage can merge into at least one flexible strut 34, which can extend partially into slot 24 at distal end 16. The material of the strut 34 can be chosen to have flexibility so that the weight of ballast 20 is sufficient to urge the locking head 26 past strut 34 and seat at the distal end of slot 24. This configuration eliminates the need for a flared niche 32, and may be advantageous in some situations. The struts could be integral to cage 12, or they could be fixed to cage 12 to extend into slot 24 as described above.

The present invention can provide the still further advantage of providing increased stability when buoy 10 has a deployment configuration. This can be because the separation distance between the center of gravity (CG) and the center of buoyancy (CB) is greater when the buoy has fully deployed. CG can be the theoretical point through which the summation of all the weight forces acts. CB can be a theoretical point though which the buoyant forces acting on the wetted surface of the hull act through. The position of CB can change depending on the draft of the vessel (buoy 10) in the water. As the vessel increases or reduces its draft so the center of buoyancy moves up or down respectively, depending on the increase or decrease of water displaced.

Figure 4:
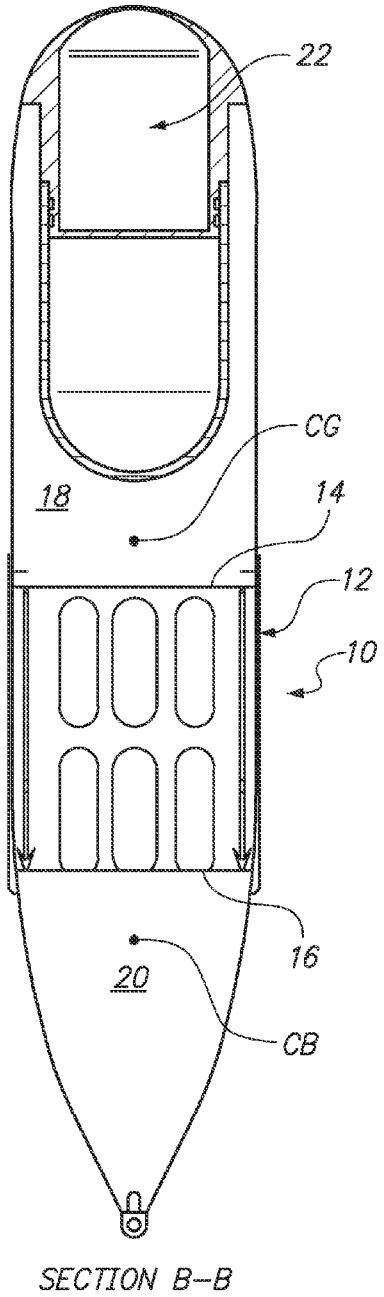
FIG. 4 is a cross-sectional view taken along line 4-4 in FIG. 3.

As shown in FIGS. 2 and 4, once ballast 20 is fully deployed the position of CG moves down (the CB also moves down, but as long as the ballast 20 is sufficiently dense, not nearly as much as the CG), and the separation distance between CB and CG is greater, which can increase the overall stability of the buoy 10. Thus, buoy 10 can withstand the forces of the waves and other obstacles without collapsing or becoming damaged by normal use. Alternatively, by the position length, material, and angle of the locking arms as described in FIG. 2, the system can be made to lock into place with any prescribed force, or even self-unlock given enough force to compress it.

As can be seen from the above, the buoy 10 of the present invention according to several embodiments can have several advantages that can set it apart from other inventions. For example, the buoy 10 can be thought as passive, in that it can deploy without any activation or arming by the user, and without any power or other overhead or resources needed for the structure and cooperation of structure described above to activate. Additionally, because of its low profile design, it will not have an adverse effect on the buoy's ability to shed kelp (such as a telescoping rod might for instance). Still further, the buoy 10 can telescope and can become part of the structure as it locks into place, the feature of the locking mechanism 28 can be key to this feature.

The inventions disclosed herein discuss buoys 10 having the structure described herein. However, any deployable device that spends part of its time traversing the water column can benefit from this design, including Unmanned Underwater Vehicles (UUV's) or bottom dwelling payloads that require orientation as they fall or have to maintain orientation once set.

Figure 7:
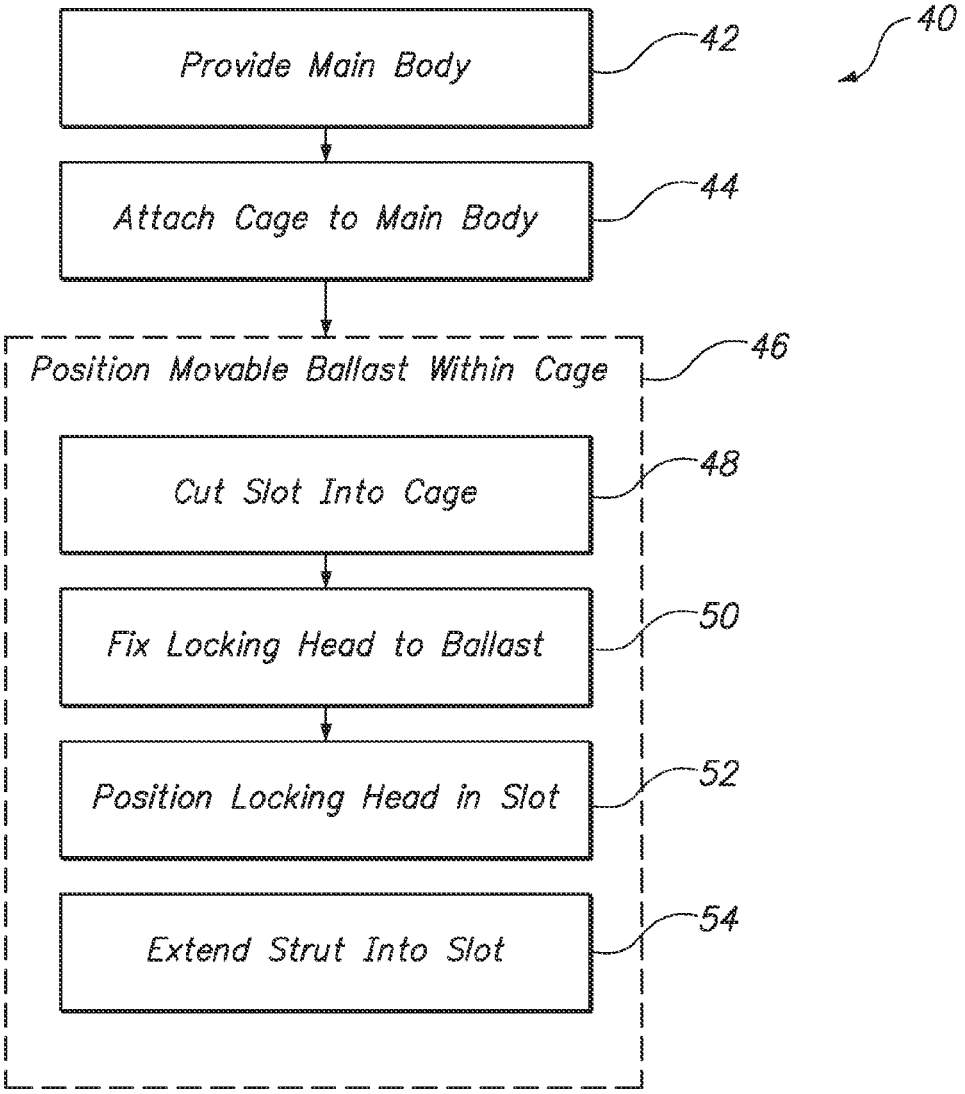

Referring now to FIG. 7, a block diagram that can depict the methods of the present invention for deploying a self-stabilizing buoy according to several embodiments is shown and annotated by reference character 40. As shown, a method 40 can include the initial step 42 of providing a main body 18 and attached a cage 12 to main body 18, as indicated by step 44 in FIG. 7. The main body and cage can have the structure described above. The methods according to several embodiments can also include the step of positioning a movable ballast 20 within cage 12, as shown by block 46. When movable ballast is within cage 12 and proximal to main body 18 (See FIGS. 1 and 2), buoy 10 is in a stowed configuration.

To "lock" ballast 20 in a deployed configuration, and as shown in FIG. 7, step 46 can include the sub-step 48 of cutting a slot 24 into cage 12, fixing a locking head 26 to ballast 20 (sub-step 50) and positioning the locking head 26 within slot 24, as shown by sub-step 52. The step 46 can also include the optional step 54 of extend a strut 34 into the distal end 16 of slot 24. When these steps are accomplished, the ballast slides out of cage 12, slides past strut(s) 34 and seats at the distal end 16 of cage 12. When this occurs, the separation distance between CB and CG increase, and the buoy becomes more stable and resistant to waves, sea state and the like. Cantilevered locking arms 30 having the structure as described above could be used in lieu of struts 34, if desired by the user.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A buoy, comprising:

a main body;

a cage attached to said main body, said cage having a proximal end and a distal end, said cage being formed with at least one slot;

a ballast, said ballast moving from within said cage at said proximal end to outside of said cage at said distal end when said buoy is deployed;

a locking mechanism for fixing said ballast at said distal end after said buoy is deployed, said locking mechanism further including a locking head fixed to said ballast and inserted into said at least one slot; and, said locking mechanism further including a means for locking said locking head at said distal end when said buoy is deployed.

2. The buoy of claim 1, wherein said locking comprises means further comprises at least one flexible cantilevered arm extending into said slot at said distal end.

3. The buoy of claim 1, wherein said locking means further comprises at least one strut extending from said cage into said slot at said distal end of said slot.

4. The buoy of claim 2 wherein said ballast has sufficient weight to urge said locking head past said at least one cantilevered arm when said buoy is deployed.

5. The buoy of claim 3 wherein said ballast has sufficient weight to urge said locking head past said at least one strut when said buoy is deployed.

6. The buoy of claim 1 wherein said buoy has a stowed configuration, a deployed configuration, a center of gravity, a center of buoyancy and a separation distance between said center of gravity and said center of buoyancy, and further wherein said separation distance is greater for said deployed configuration than for said stowed configuration.

7. A buoy, comprising:

a ballast;

a cage surrounding said ballast, said cage having a proximal end and a distal end and being formed with a slot;

a body attached to said proximal end of said cage;

said ballast sliding from within said cage from said proximal end when said buoy is stowed to said distal end when said buoy is deployed;

a locking mechanism for fixing said ballast at said distal end after said buoy is deployed, said locking mechanism further including a locking head fixed to said ballast and inserted into said at least one slot; and, said locking mechanism further including a means for locking said locking head at said distal end when said buoy is deployed.

8. The buoy of claim 7, wherein said locking means further comprises at least one flexible cantilevered arm extending into said slot at said distal end.

9. The buoy of claim 7, wherein said locking means further comprises at least one strut extending from said cage into said slot at said distal end of said slot.

10. The buoy of claim 8 wherein said ballast has sufficient weight to urge said locking head past said at least one cantilevered arm when said buoy is deployed.

11. The buoy of claim 9 wherein said ballast has sufficient weight to urge said locking head past said at least one strut when said buoy is deployed.

12. The buoy of claim 7 wherein said buoy has a stowed configuration, a deployed configuration, a center of gravity, a center of buoyancy and a separation distance between said center of gravity and said center of buoyancy, and further wherein said separation distance is greater for said deployed configuration than for said stowed configuration.

13. A method for deploying a buoy, comprising the steps of:

A) providing a main body;

B) attaching a cage to said main body, said cage having a proximal end and a distal end;

C) positioning a movable ballast within said cage so that said ballast moves from within said cage at said proximal end when said buoy is stowed to outside of said cage at said distal end when said buoy is deployed C1) cutting at least one slot into said cage;

C2) fixing a locking head to said ballast; and,

C3) positioning said locking head in said slot.

14. The method of claim 13, further comprising the step of partially extending at least one flexible cantilevered arm from said cage into said distal end of said slot; and, wherein said step C3) is accomplished using a ballast having sufficient weight to urge said locking head past said at least one cantilevered arm during said deployment method.

15. The method of claim 13, further comprising the step of:

partially extending at least one flexible strut from said cage into said distal end of said slot; and, wherein said step C3) is accomplished using a ballast having sufficient weight to urge said locking head past said at least one flexible strut.

16. The method of claim 15, wherein said buoy has a stowed configuration, a deployed configuration, a center of gravity, a center of buoyancy and a separation distance between said center of gravity and said center of buoyancy, and further wherein said step C) is accomplished so that said separation distance is greater for said deployed configuration than for said stowed configuration.

* * * * *